United States Patent [19]

Suzuki

[11] Patent Number: 4,887,505

[45] Date of Patent: Dec. 19, 1989

[54] ELECTRONIC MUSICAL INSTRUMENT CAPABLE OF PERFORMING AN AUTOMATIC ACCOMPANIMENT

[75] Inventor: Statoshi Suzuki, Hamamatsu, Japan

[73] Assignee: Yamaha Corporation, Shizuoka, Japan

[21] Appl. No.: 208,381

[22] Filed: May 17, 1988

[30] Foreign Application Priority Data

Jun. 26, 1987 [JP] Japan ..... 62-159367
Jun. 26, 1987 [JP] Japan ..... 62-159368

[51] Int. Cl.[4] ..... G10H 1/06; G10H 1/42; G10H 7/00

[52] U.S. Cl. ..... 84/714; 84/DIG. 12

[58] Field of Search ..... 84/1.03, 1.11–1.13, 84/1.19–1.23, 1.28

[56] References Cited

U.S. PATENT DOCUMENTS 4,232,581 11/1980 Uchiyama .
4,674,384 6/1987 Sakurai ..... 84/1.03
4,699,039 10/1987 Oguri et al. .
4,814,401 1/1980 Hiyoshi et al. .

FOREIGN PATENT DOCUMENTS 54-8926 1/1979 Japan .
61-292692 12/1986 Japan .
62-38698 3/1987 Japan .

*Primary Examiner*—Stanley J. Witkowski
*Attorney, Agent, or Firm*—Spensley Horn Jubas & Lubitz

[57] ABSTRACT

An electronic musical instrument capable of performing an automatic accompaniment contains at least a tempo clock generator, a pattern memory, a manipulating section and a tone generator. The manipulating section includes at least a rhythm selecting switch for selecting a rhythm kind and a tempo speed control switch which controls the tempo clock generator to thereby change a tempo speed. The pattern memory stores a plurality of tone data each representative of a tone color and a plurality of pattern data each representative of a performance pattern. The tempo speed is divided into three speed areas. The tone data and pattern data are sequentially read from the pattern memory based on the selected rhythm kind and each speed area. Based on such read tone data and pattern data, the tone generator generates a musical tone signal by which desirable musical tones are to be generated.

13 Claims, 6 Drawing Sheets

( TEMPO SPEED DIVISION )

( CHORD INFORMATION )

( PATTERN MEMORY )

ELECTRONIC MUSICAL INSTRUMENT CAPABLE OF PERFORMING AN AUTOMATIC ACCOMPANIMENT

BACKGROUND OF THE INVENTION

1. Field of the Invention

The present invention generally relates to an electronic musical instrument capable of performing an automatic accompaniment, and more particularly to an electronic musical instrument capable of changing an accompaniment pattern or a tone color of accompaniment tone in response to a tempo.

2. Prior Art

As the conventional electronic musical instrument capable of automatically changing the accompaniment pattern, the Japanese Patent Laid-Open Publication No. 61-292692 discloses an automatic accompaniment apparatus in which a kind of accompaniment chord is detected to thereby change the accompaniment pattern. In such electronic musical instrument, the chords are divided into several chord groups such as major chords, minor chords and seventh chords, for example. As the tune progresses, the present chord must be changed. Hence, the above electronic musical instrument changes the accompaniment pattern based on which chord group the present chord belongs to.

The above electronic musical instrument can change the accompaniment pattern without manipulating switching members. However, since the accompaniment pattern must be directly determined depending on the chord progress of the tune, one accompaniment mode must be fixed at one tune. Hence, the above electronic musical instrument is disadvantageous in that a variation of performance must be limited.

On the other hand, as the conventional electronic musical instrument capable of automatically changing the tone color of the automatic accompaniment tone, the Japanese Utility Model Laid-Open No. 62-38698 discloses a first automatic accompaniment apparatus which executes a tone color control in response to a rhythm pattern of automatic accompaniment, and another Japanese Utility Model Laid-Open No. 54-8926 discloses a second automatic accompaniment apparatus which executes a tone color control in response to a touch intensity of keyboard.

However, once the rhythm is determined in the above first electronic musical instrument, the tone color must be directly determined, regardless of the image of tune. For this reason, the first automatic accompaniment apparatus is disadvantageous in that the variation of tone color must be limited. In this case, it is possible to manually change the tone color by use of a tone color selecting switch and the like. However, it is not possible to automatically change the tone color in connection with the image of tune.

In addition, a high performance technique must be required in the above second automatic accompaniment apparatus. Hence, it is disadvantageous in that it is difficult for the beginner to play the electronic musical instrument with the second automatic accompaniment apparatus.

SUMMARY OF THE INVENTION

It is accordingly a primary object of the invention to provide an electronic musical instrument which can change the accompaniment mode in the same tune so that it is possible to perform the accompaniment with much variation in response to the image of player etc.

It is another object of the invention to provide an electronic musical instrument in which the tone color of accompaniment tone can be changed in response to the image of tune so that the high performance technique will become unnecessary.

In a first aspect of the invention, there is provided an electronic musical instrument comprising:

(a) tempo signal generating means for generating a tempo signal;

(b) tempo speed control means for controlling a tempo speed of the tempo signal;

(c) pattern generating means for generating pattern data for performing an automatic accompaniment in accordance with the tempo signal, the pattern generating means generating different pattern data in response to a control state of the tempo speed controlled by the tempo speed control means; and (d) automatic accompaniment tone generating means for automatically generating an accompaniment tone based on the pattern data generated from the pattern generating means.

In a second aspect of the invention, there is provided an electronic musical instrument comprising:

(a) tempo signal generating means for generating a tempo signal;

(b) tempo speed control means for controlling a tempo speed of the tempo signal;

(c) pattern generating means for generating pattern data for performing an automatic accompaniment in accordance with the tempo signal;

(d) automatic accompaniment tone generating means for automatically generating an accompaniment tone based on the pattern data; and (e) tone color control means for controlling a tone color of the accompaniment tone in response to a control state of the tempo speed controlled by the tempo speed control means.

In a third aspect of the invention, there is provided an electronic musical instrument capable of performing an automatic accompaniment comprising:

(a) control means for controlling several portions to thereby execute several processes;

(b) register means including several kinds of registers each used for executing processes of the control means;

(c) a tempo clock generator for generating a tempo clock whose cycle corresponds to a tempo speed of automatic accompaniment to be performed;

(d) a keyboard for generating key event data in accordance with the performance thereof;

(e) a manipulating section including several kinds of switches for determining tempo and rhythm kind;

(f) a pattern memory for storing several kinds of performance patterns used for performing the automatic accompaniment; and (g) a tone generator for generating a musical tone signal corresponding to the performance pattern read from the pattern memory under control of the control means, whereby the automatic accompaniment can be performed based on the musical tone signal.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF PREFERRED EMBODIMENT

[A] CONSTITUTION OF EMBODIMENT

Figure 1:
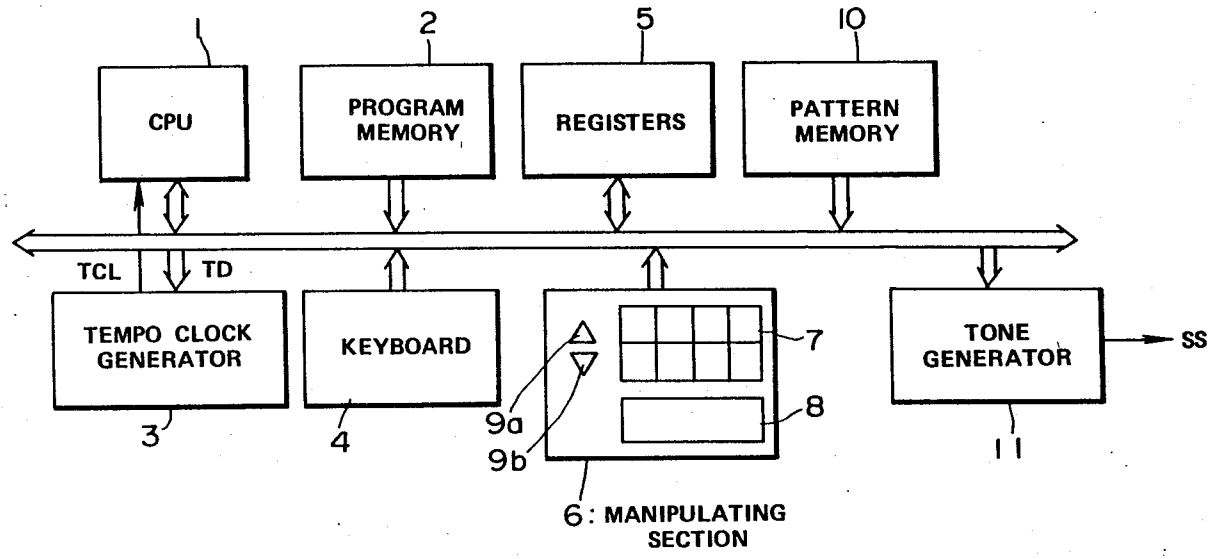
FIG. 1 is a block diagram showing an electric constitution of an embodiment of the present invention.

Referring now to the drawings, wherein FIG. 1 is a block diagram showing an electric constitution of an embodiment of the present invention. In FIG. 1, 1 designates a central processing unit (CPU) for controlling several portions of the present embodiment, and 2 designates a program memory for storing programs used by the CPU 1. 3 designates a tempo clock generator for generating a tempo clock TCL having a cycle corresponding to a tempo of tune, and this tempo clock TCL is supplied to the CPU 1 as an interrupt signal. 4 designates a keyboard including key switches each corresponding to each of a plurality of keys, and a key-on/key-off signal of each key switch is supplied to the CPU 1. 5 designates registers including several registers which are used in processes of the CPU 1. Next, description will be given with respect to each of the registers.

(1) Register TEMPO: a register written by tempo speed data TD determining the cycle of tempo clock TCL, and this tempo speed data TD are supplied to the tempo clock generator 3 via the CPU 1 so that the tempo of tune will be set.

Table 1 shows relations among the tempo speed data TD, the tempo of tune and the tempo clock TCL.

TABLE 1

| TEMPO | SECTION/MINUTE | INTERRUPT/MINUTE |
|---|---|---|
| 0 | 32 | 256 |
| 1 | 36 | 288 |
| 2 | 40 | 320 |
| . | . | . |
| . | . | . |
| . | . | . |
| 62 | 272 | 2176 |
| 63 | 280 | 2240 |

*The word "section" is defined as a quarter period of one bar of 4/4 time, or one third period of one bar of ¾ time, for example.

As shown in Table 1, the value of tempo speed data TD stored in the register TEMPO varies between "0" to "63", and each value thereof corresponds to each of tempos of "32" to "280" sections per one minute. In addition, one section corresponds to eight cycles of tempo clock TCL. As a result, interrupt processes can be executed against the CPU 1 by eight times within one section.

(2) Register SEL: a register stored with rhythm select data for selecting a rhythm kind, and this register can store numerical data representative of numbers "0" to "15". In short, sixteen kinds of rhythms can be selected in the present embodiment.

Figure 2:
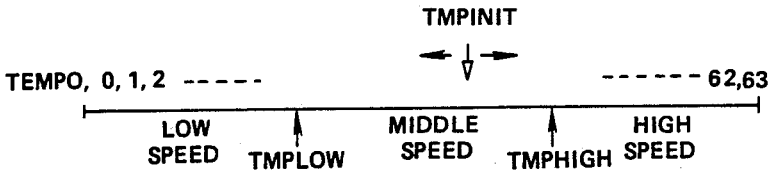
FIG. 2 shows an example of divisions of tempo speed.

(3) Register TMPLOW: a register written by a boundary tempo speed between a low speed area and a middle speed area in the case where the tempo of tune is divided into three areas representative of low speed, middle speed and high speed as shown in FIG. 2. This register TMPLOW is provided for each rhythm kind in order to execute a boundary setting in accordance with each rhythm, because speed feeling of tune depends on each rhythm kind.

(4) Register TMPHIGH: a register written by a boundary tempo speed existed between the middle speed area and the high speed area as shown in FIG. 2. Similar to the above-mentioned register TMPLOW, this register TMPHIGH is provided for each rhythm kind.

(5) Register PTNO:

The present embodiment can perform the automatic accompaniment in accordance with different pattern at each rhythm kind. In addition, the present embodiment can set three rhythm patterns of pattern "1" to pattern "3" in one rhythm kind, and each of these rhythm patterns can be selectively changed over by every speed area. The register PTNO is the register written by the pattern numbers "1" to "3", and the stored content thereof can be rewritten in response to the detection result of tempo speed due to the CPU 1.

(6) Register CLK: a register for repeatedly counting the tempo clock TCL in a range of values "0" to "31".

(7) Register RUN: a register written by value "1" in an automatic accompaniment mode and also written by value "0" when the automatic accompaniment is not performed.

Figure 3:
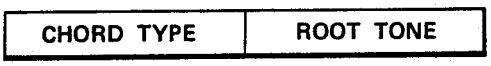
FIG. 3 shows a constitution of chord information.

(8) Register CHORD: a register written by the chord information concerning the performance of keyboard 4. As shown in FIG. 3, this register CHORD is written by data representative of the chord type (i.e., the major chord, minor chord and seventh chord etc.) and root tone (i.e., C tone, C# tone, D tone, and the like).

(9) Register TMPINIT: a register preset by predetermined tempo speed data. When this register TMPINIT is called by the operation which will be mentioned later, the stored content thereof is supplied to the tempo clock generator 3 via the CPU 1. This register TMPINIT is provided for each rhythm pattern.

As described above, the registers 5 respectively function. The following Table 2 shows set values of the registers TMPHIGH, TMPLOW and TMPINIT in cases of samba rhythm and swing rhythm. In Table 2, the value within parentheses represents section number within one minute.

TABLE 2

| | SAMBA | SWING |
|---|---|---|
| TMPHIGH | 52(192) | 26(100) |
| TMPINIT | 36(120) | 16(80) |
| TMPLOW | 21(90) | 5(52) |

In FIG. 1, 6 designates a manipulating section including a rhythm selecting switch 7 for selecting a desirable rhythm, switches 8 which are used for executing other operations, an UP switch 9*a* and a DOWN switch 9*b*. The stored the content of register TEMPO is incremented by one when the UP switch 9*a* is depressed, while the stored content of the register TEMPO is decremented by one when the DOWN switch 9*b* is depressed.

Figure 4:
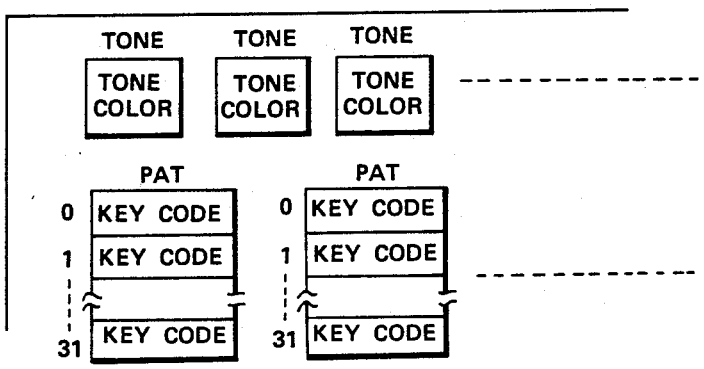
FIG. 4 is a drawing showing contents stored in a pattern memory shown in FIG. 1.

In addition, 10 designates a pattern memory which stores several kinds of performance patterns used for the automatic accompaniment. FIG. 4 shows stored content of this pattern memory 10. As shown in FIG. 4, this pattern memory 10 stores tone data TONE each designating the tone color and pattern data PAT each corresponding to the performance pattern. The tone data TONE are set by each rhythm kind and by each speed area. Therefore, total 16×3 tone data TONE are stored in the pattern memory 10.

The pattern data PAT are the data including a plurality of key codes. The number of stored pattern data PAT corresponds to the combination of rhythm kinds, chord types and speed areas. This key code is the code for designating the key whose tone is to be generated.

In this case, as the pattern data PAT, key codes of one bar are sequentially stored in "0" to "31" areas as the tune progresses. Such stored key codes are read from these areas within the pattern memory in response to the stored content of register CLK.

Figure 5A:
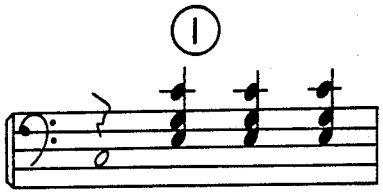
FIGS. 5A to 5C show scores representative of an example of accompaniment pattern.
Figure 5B:
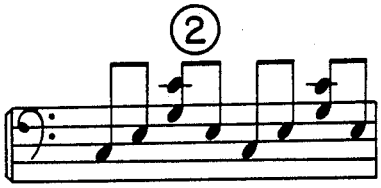
Figure 5C:
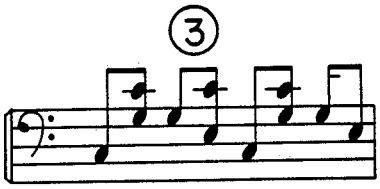

FIGS. 5A to 5C each show an example of a performance pattern in a predetermined rhythm. Each of FIGS. 5A to 5C shows each of performance patterns "1", "2" and "3" corresponding to the tempo speeds of low speed area, middle speed area and high speed area in the predetermined rhythm. In this case, the performance pattern "1" is set to a tone color of organ, the performance pattern "2" is set to a tone color of piano and the performance pattern "3" is set to a tone color of banjo. Therefore, as the pattern data of the predetermined rhythm, the combination of the following three kinds of data (i) to (iii) will be stored in the pattern memory 10:

(i) data whose tone data TONE represent the tone color of "organ" and pattern data PAT correspond to the bar of FIG. 5A;

(ii) data whose tone data TONE represent the tone color of "piano" and pattern data PAT correspond to the bar of FIG. 5B; and (iii) data whose tone data TONE represent the tone color of "banjo" and pattern data PAT correspond to the bar of FIG. 5C.

Incidentally, FIGS. 5A to 5C represent the example of performance pattern of complex tones. In order to generate such complex tones, the number of provided pattern data must be identical to the number of generated tones within such complex tones.

Next, 11 shown in FIG. 1 designates a tone generator for generating a musical tone signal having a tone color corresponding to the tone data TONE which are read from the pattern memory 10 via the CPU 1 at the right timings. In addition, this musical tone signal has the performance pattern corresponding to the pattern data PAT. This musical tone signal is supplied to a sound system (SS; not shown) wherein the musical tone (i.e., the automatic accompaniment tone) is generated based on the supplied musical tone signal.

[B] OPERATION OF EMBODIMENT

Next, description will be given with respect to operations of the present embodiment in conjunction with flowcharts shown in FIGS. 6A to 6D.

Figure 6A:
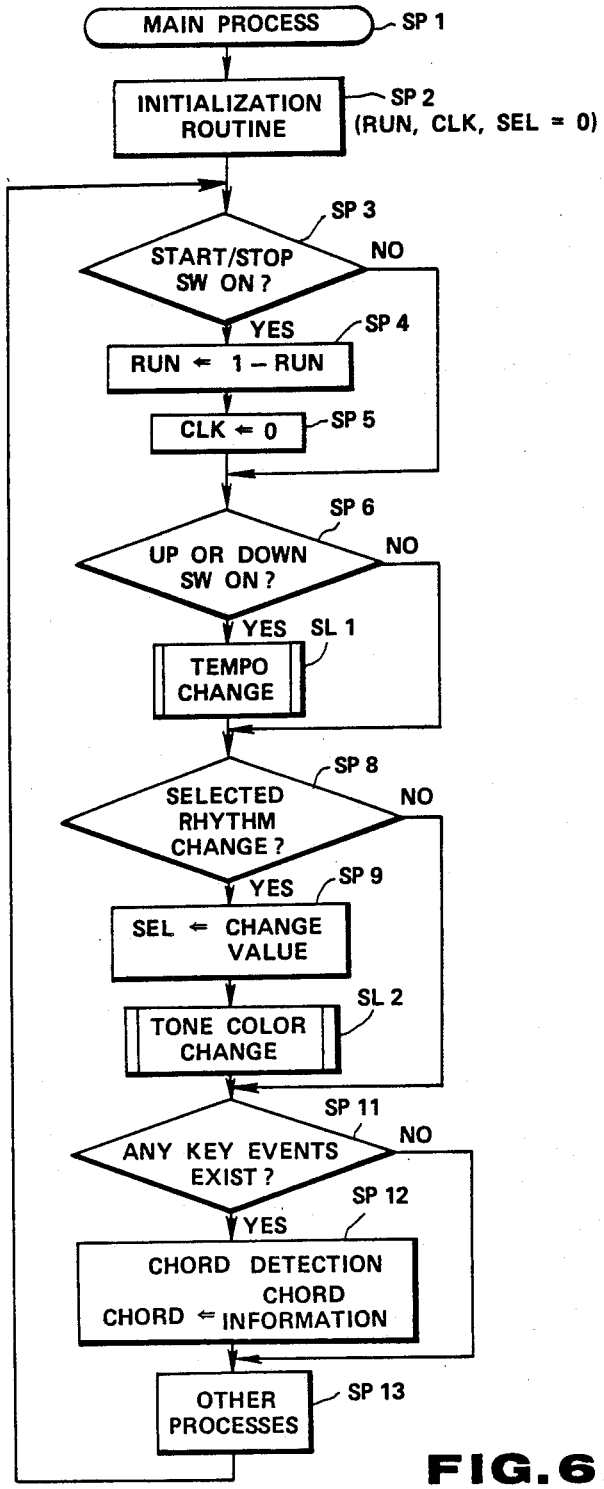
FIGS. 6A to 6D are flowcharts showing operations of an embodiment of the present invention.

First, in FIG. 6A, steps SP1 to SP13 designate a main routine, wherein an initialization process is executed in a step SP2. In this initialization process, each of the contents of the registers RUN, CLK and SEL etc. is reset to "0". In a next step SP3, it is judged whether a start/stop switch for controlling start/stop of automatic accompaniment (which is provided within the switches 8 shown in FIG. 1) is turned on or not. When the judgment result of this step SP3 is "YES", the processing proceeds to a step SP4 wherein the content of register RUN is inverted. According to the above processes in the steps SP3 and SP4, the content of register RUN is inverted at every time when the start/stop switch is depressed. After the content of register RUN is inverted in the step SP4, the register CLK is reset in a step SP5. This reset is done in order to adjust the start timing of automatic performance to the head timing of bar. Next, after executing this process in the step SP5, or after the judgment result of the step SP3 turn to "NO", the processing proceeds to a step SP6 wherein it is judged whether the UP switch 9a or the DOWN switch 9b is depressed or not. When the judgment result of this step SP6 is "YES", the processing will proceed to a step SP8 after executing a process of tempo change subroutine SL1. When the judgment result of this step SP6 is "NO", the processing directly proceeds to the step SP8.

Figure 6B:
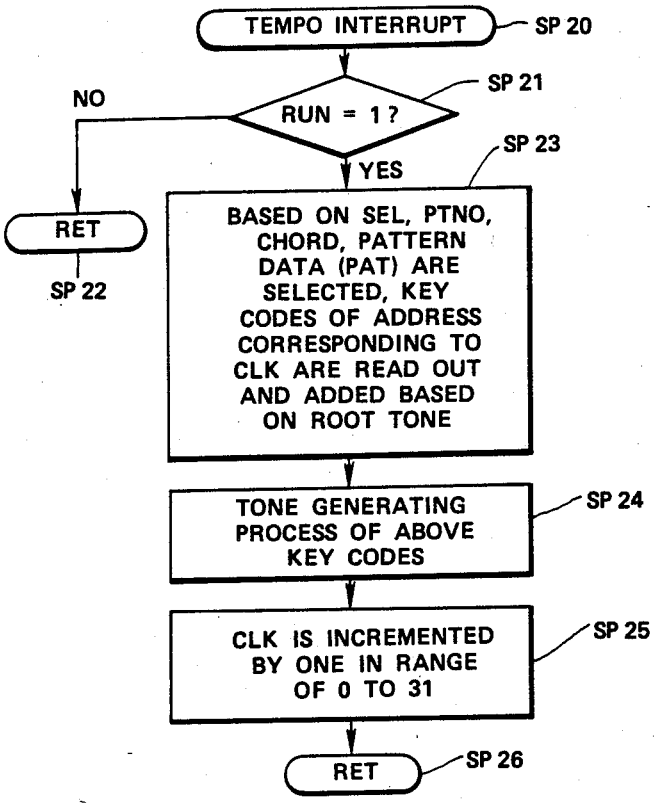
Figure 6C:
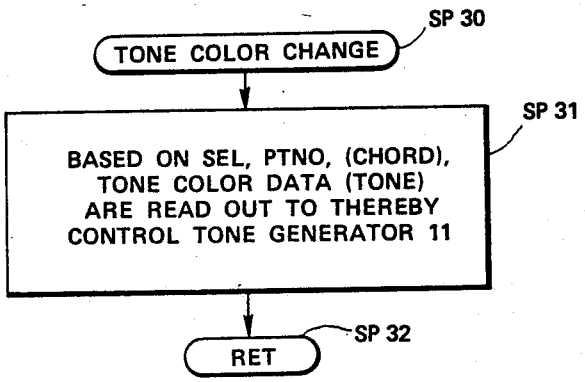
Figure 6D:
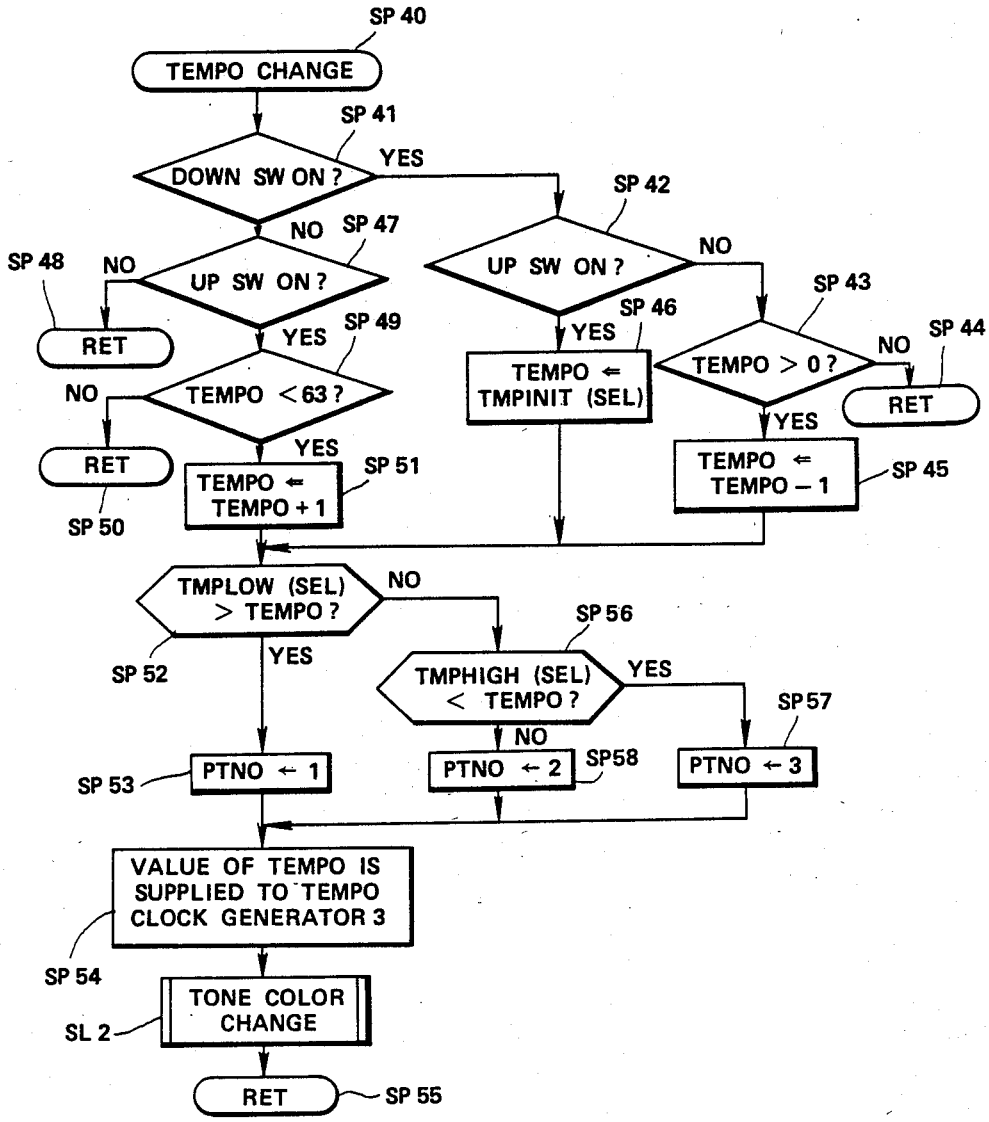

As shown in FIG. 6D, the above tempo change subroutine SL1 is the routine consisting of steps SP40 to SP55. In this routine, it is first judged whether the DOWN switch 9b is "ON" or not in a step SP41. When the judgment result of this step SP41 is "YES", the processing proceeds to a step SP42 wherein it is judged whether the UP switch 9a is depressed or not. The judgment result of this step SP42 turns to "NO" in the case where only the DOWN switch 9b is depressed. In this case, the processing passes through a step SP43 and then proceeds to a step SP45 wherein the content of register TEMPO is decremented by one. The process of the step SP43 is the process wherein it is judged whether the content of register TEMPO is larger than "0" or not. In the case where the judgment result of this step SP43 is "NO", the decrement process cannot be executed on the register TEMPO. Hence, in this case, the processing immediately returns to the main routine via a step SP44.

On the other hand, the case where the judgment result of the step SP42 is "YES" is the case where both of the UP switch 9a and DOWN switch 9b are simultaneously depressed. In this case, the processing proceeds to a step SP46 wherein the register TEMPO is written by the data stored in the register TMPINIT (which must correspond to the selected rhythm at this time). Therefore, the content of register TEMPO is rewritten by the data preset in the register TMPINIT, regardless of the preceding value thereof.

Meanwhile, in the case where the judgment result of the step SP41 is "NO", the processing proceeds to a step SP47 wherein it is judged whether the UP switch 9a is "ON" or not. When the judgment result of this step SP47 is "NO", the processing returns to the main routine via a step SP48. On the other hand, when the judgment result of this step SP47 is "YES", the processing passes through a step SP49 and then proceeds to a step SP51 wherein the content of register TEMPO is incremented by one. The step SP49 indicates the process wherein the content of register TEMPO is smaller than "63" or not. In the case where the judgment result of this step SP49 is "NO", the increment process cannot be executed on the register TEMPO. Hence, in this case, the processing returns to the main routine via a step SP50.

According to the processes in the steps SP41 to SP51 described heretofore, the content of register TEMPO is incremented or decremented or rewritten by the content of register TMPINIT in accordance with the operations of the UP switch 9a and DOWN switch 9b.

Next, in a step SP52, it is judged whether the value of data stored in the register TEMPO is smaller than that of data stored in the register TMPLOW (which must correspond to the selected rhythm at this time). In the case where the judgment result of this step SP52 is "YES", the data stored in the register TEMPO are existed in the low speed area at this rhythm. Hence, in this case, the processing proceeds to a step SP53 wherein value "1" is written in the register PTNO. On the other hand, in the case where the judgment result of the step SP52 is "NO", the processing proceeds to a step SP56 wherein it is judged whether the value of data stored in the register TEMPO is larger than that of data stored in the register TMPHIGH or not. In the case where the judgment result of this step SP56 is "YES", the data stored in the register TEMPO must be existed in the high speed area. Hence, in this case, the processing proceeds to a step SP57 wherein value "3" is written in the register PTNO. On the other hand, in the case where the judgment result of the step SP56 is "NO", the data stored in the register TEMPO must be existed in the middle speed area. Hence, in this case, the processing proceeds to a step SP58 wherein value "2" is written in the register PTNO.

Due to these processes in the steps SP52, SP53, SP56 to SP58 described heretofore, the data designating the pattern number corresponding to the tempo speed are written in the register PTNO.

Next, the processing proceeds to a step SP54 wherein the data stored in the register TEMPO are supplied to the tempo generator 3 so that cycles for generating the tempo clock TCL will be set. Then, the process of tone color change process routine SL2 is executed. This tone color change process routine SL2 consists of steps SP30 to SP32 shown in FIG. 6C. In a step SP31, the tone data TONE are read from the pattern memory 10 based on the contents stored in the registers SEL and PTNO, and the read tone data TONE are supplied to the tone generator 11 to thereby control the tone color of the musical tone signal. After executing such process in the step SP31, the processing sequentially passes through the steps SP32 and SP55 (shown in FIG. 6D) and then returns back to the main routine.

Next, in a step SP8 shown in FIG. 6A, it is judged whether there is any change in the state of rhythm selecting switch 7 or not. When any change is occurred in the state of rhythm selecting switch 7, the processing proceeds to a step SP9 wherein the register SEL is written by the value corresponding to the operation of the rhythm selecting switch 7. Next, the process of tone color change subroutine SL2 is executed, whereby the tone data TONE corresponding to newly selected rhythm are read out and then the read tone data TONE are supplied to the tone generator 11. Thus, the tone color of the musical tone signal generated from the tone generator 11 will be changed.

After executing the above process of subroutine SL2, or after the judgment result of the step SP8 turns to "NO", the processing proceeds to a step SP11 wherein it is judged whether any key events are occurred within the keys of keyboard 4 or not. In the present specification, "event" means a change of key state. Hence, there are two kinds of events, i.e., a change from "ON" to "OFF" and a change from "OFF" to "ON". In the case where the key event is occurred, a next step SP12 executes a tone generating process in response to the event and also executes a chord detection. Then, the chord type and root tone are written in the register CHORD based on the detection result of chord. After executing the process of step SP12, or after the judgment result of step SP11 turns to "NO", the processing proceeds to a step SP13 wherein other processes are executed. Then, the processing returns to the step SP3 again. Thereafter, the processes of the steps SP1 to SP13 etc. described heretofore are repeatedly executed.

By the processes described heretofore, the contents stored in the registers used for the automatic performance process are adequately set.

Meanwhile, the tempo clock generator 3 outputs the tempo clock TCL by the cycle corresponding to the content stored in the register TEMPO, whereby the interrupt process is executed against the CPU 1. Thus, at every time when the interrupt is occurred, the CPU 1 executes an interrupt process routine consisting of steps SP20 to SP26 shown in FIG. 6B. In other words, this interrupt process is the automatic accompaniment process. In a first step SP21 of this routine, it is judged whether the value of register RUN is equal to "1" or not. When the value of register RUN is not equal to "1", the processing immediately returns to the main routine via a step SP22. Because, the case where the value of register RUN is not equal to "1" does not designate the automatic accompaniment mode.

On the contrary, in the case where the judgment result of the step SP21 is "YES", the processing proceeds to a step SP23. This step SP23 selects the pattern data PAT corresponding to the contents stored in the registers SEL, PTNO and CHORD within the pattern memory 10. In addition, the step SP23 reads out the key codes at the addresses corresponding to the value of register CLK from the selected pattern data PAT. Then, these key codes are added together based on the root tone data stored in the register CHORD. Next, the processing proceeds to a step SP24 wherein the above added key codes are supplied to the tone generator 11 so that the tone generating process will be executed. After executing such tone generating process, the processing proceeds to a step SP25 wherein the content of the register CLK is incremented by one. However, in the case where the content of the register CLK is equal to "31", such content is reset to value "0". In other words, the step SP25 executes the process for periodically counting up the value of register CLK in a range between values "0" to "31". After incrementing the value of register CLK in this step SP25, the processing returns to the main routine via a step SP26.

The above-mentioned interrupt process subroutine shown in FIG. 6B is executed at every time when the tempo clock TCL is supplied to the CPU 1, whereby the automatic accompaniment will be performed.

Above is the description of the present embodiment. This invention can be practiced or embodied in still other ways without departing from the spirit or essential character thereof. For example, the present embodiment can be modified as described below.

(1) A plurality of patterns for simultaneously generating the tones can be provided, so that the complex tone generation can be realized.

(2) In the present embodiment, the tone color and pattern are changed at the same time. However, it is possible to respectively set the tempo boundary for changing the tone color and another tempo boundary for changing the pattern.

(3) In addition to the circuit for performing the automatic accompaniment, it is possible to further provide a circuit for generating a melody tone.

(4) It is possible to use the pattern data (which are used as the accompaniment data in the present embodiment) as rhythm pattern data for the rhythm accompaniment so that the rhythm accompaniment will be changed.

(5) It is possible to set the set value of register TMPINIT in the low speed area or the high speed area other than the middle speed area.

(6) In the present embodiment, the tempo pattern is changed by three stages in response to the tempo speed. However, this tempo pattern can be changed by two stages or by four stages and more.

Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:
(a) tempo signal generating means for generating a tempo signal;
(b) tempo speed control means for controlling a tempo speed of said tempo signal;
(c) pattern generating means for generating pattern data for performing an automatic accompaniment in accordance with said tempo signal, said pattern generating means generating different pattern data in response to a control state of said tempo speed controlled by said tempo speed control means; and
(d) automatic accompaniment tone generating means for automatically generating an accompaniment tone based on said pattern data generated from said pattern generating means.

2. An electronic musical instrument according to claim 1, wherein said pattern generating means generates said pattern data which correspond to said speed of said tempo signal controlled by said tempo speed control means and also correspond to a selected rhythm kind.

3. An electronic musical instrument according to claim 1, wherein said tempo speed is divided into three stages of high speed, middle speed and low speed, said pattern generating means being capable of generating three pattern data corresponding to the three speeds respectively.

4. An electronic musical instrument according to claim 3, wherein a boundary tempo speed between two of said high speed, middle speed and low speed is changed by the selected rhythm in said pattern generating means.

5. An electronic musical instrument comprising:
(a) a tempo signal generating means for generating a tempo signal;
(b) tempo speed control means for controlling a tempo speed of said tempo signal;
(c) pattern generating means for generating pattern data for performing an automatic accompaniment in accordance with said tempo signal;
(d) automatic accompaniment tone generating means for automatically generating an accompaniment tone based on said pattern data; and
(e) tone color control means for controlling a tone color of said accompaniment tone as a function of said tempo speed.

6. An electronic musical instrument according to claim 5, wherein said tone color control means executes a tone color control corresponding to said tempo speed controlled by said tempo speed control means and also corresponding to a selected rhythm kind.

7. An electronic musical instrument according to claim 5, wherein said tempo speed is divided into three stages of high speed, middle speed and low speed, said tone color control means executing said tone color control by three stages corresponding to the three speeds respectively.

8. An electronic musical instrument according to claim 7, wherein a boundary tempo speed between two of said high speed, middle speed and low speed is changed by a selected rhythm in said tone color control means.

9. An electronic musical instrument according to claim 5 wherein said tone color control means detects a change in said tempo speed and selects a new tone color when said new tempo speed is within a predetermined range.

10. An electronic musical instrument capable of performing an automatic accompaniment comprising:
(a) a keyboard for generating key event data in accordance with the performance thereof;
(b) control means for controlling a music performance generated in accordance with an operation of said keyboard;
(c) register means comprising a plurality of registers each writing and reading out specific data under the control of said control means;
(d) a tempo clock generator for generating a tempo clock whose cycle corresponds to a tempo speed of an automatic accompaniment to be performed;
(e) manipulator means for determining a tempo and rhythm kind for said automatic accompaniment;
(f) a pattern memory for storing a plurality of performance patterns used for performing said automatic accompaniment;
(g) pattern generating means for reading one of said performance patterns from said pattern memory under the control of said control means, said pattern generating means reading a new performance pattern when said manipulator means designates at least one of a new tempo within a predetermined range and a new rhythm kind; and
(h) a tone generator for generating a musical tone signal corresponding to said performance pattern read from said pattern memory under the control of said control means whereby said automatic accompaniment can be performed based on said musical tone signal.

11. An electronic musical instrument according to claim 10, wherein said pattern memory stores a plurality of tone data each representative of a tone color and a plurality of pattern data each representative of said performance pattern, said pattern data consisting of key codes each designating a key within said keyboard whose tone to be generated.

12. An electronic musical instrument according to claim 10, wherein said manipulator means comprises a rhythm selecting switch for selecting said rhythm kind of said automatic accompaniment and a tempo speed control switch for controlling said tempo clock generator to thereby change said tempo speed of said automatic accompaniment.

13. An electronic musical instrument according to claim 10, wherein said tempo speed is divided into three tempo speed areas, corresponding to a low speed area, middle speed area and high speed area respectively, so that said tone color and performance pattern of said automatic accompaniment to be performed will be determined based on the selected tempo speed area.

* * * * *

UNITED STATES PATENT AND TRADEMARK OFFICE

CERTIFICATE OF CORRECTION

PATENT NO. : 4,887,505

DATED : December 19, 1989

INVENTOR(S) : Satoshi Suzuki

It is certified that error appears in the above-identified patent and that said Letters Patent is hereby corrected as shown below:

On the title page, at "[75] Inventor:", "Statoshi" should be --Satoshi--.

Signed and Sealed this

Twenty-first Day of May, 1991

*Attest:*

HARRY F. MANBECK, JR.

*Attesting Officer*

*Commissioner of Patents and Trademarks*